US011383955B2

(12) United States Patent
Gurvich et al.

(10) Patent No.: US 11,383,955 B2
(45) Date of Patent: Jul. 12, 2022

(54) ELEVATOR SYSTEM CONTROL BASED ON BUILDING AND ROPE SWAY

(71) Applicant: OTIS ELEVATOR COMPANY, Farmington, CT (US)

(72) Inventors: Mark R. Gurvich, Middletown, CT (US); Mark Steven Thompson, Tolland, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 766 days.

(21) Appl. No.: 16/260,575

(22) Filed: Jan. 29, 2019

(65) Prior Publication Data

US 2020/0239274 A1 Jul. 30, 2020

(51) Int. Cl.
*B66B 1/34* (2006.01)
*B66B 1/28* (2006.01)

(52) U.S. Cl.
CPC ..... *B66B 1/3492* (2013.01); *B66B 1/28* (2013.01); *B66B 1/3476* (2013.01)

(58) Field of Classification Search
CPC .. B66B 5/022; B66B 5/02; B66B 1/34; B66B 1/3492; B66B 5/021; B66B 5/0018; B66B 5/0006; B66B 3/02; B66B 7/028; B66B 7/021
See application file for complete search history.

(56) References Cited

U.S. PATENT DOCUMENTS 4,117,908 A 10/1978 Nara et al.
5,103,937 A 4/1992 Robertson
5,861,084 A 1/1999 Barker et al.
7,793,763 B2 9/2010 Zhu et al.
7,905,329 B2 3/2011 Urata
8,297,412 B2 10/2012 Roberts et al.
9,359,172 B2 6/2016 Mangini et al.
(Continued)

FOREIGN PATENT DOCUMENTS

CN 103935865 A 7/2014
EP 3398897 A1 11/2018
(Continued)

OTHER PUBLICATIONS

Japanese Patent Application No. JP 2019-229845, Notice of Reasons for Rejection dated Dec. 1, 2020.
(Continued)

*Primary Examiner* — Marlon T Fletcher
(74) *Attorney, Agent, or Firm* — Carlson, Gaskey & Olds, P.C.

(57) ABSTRACT

An illustrative example elevator control system includes a plurality of sway sensors situated within a hoistway of the building. The sway sensors respectively include a contact surface situated to be contacted by a vertically extending elongated member of an elevator when the elongated member moves laterally in the hoistway. The sway sensors respectively provide an indication of contact between the contact surface and the elongated member. A controller receives an indication of building movement and the indications from the sway sensors. The controller determines whether at least one condition exists in the hoistway based on the indications and implements an adjustment to elevator movement control when the at least one condition exists.

18 Claims, 2 Drawing Sheets

(56) References Cited

U.S. PATENT DOCUMENTS

| | | | | |
|---|---|---|---|---|
| 10,099,895 | B2 | 10/2018 | Miseur et al. | |
| 2013/0048438 | A1 | 2/2013 | Mangini et al. | |
| 2014/0000985 | A1 | 1/2014 | Fukui et al. | |
| 2016/0017708 | A1 | 1/2016 | Cao et al. | |
| 2018/0290862 | A1 | 10/2018 | Copeland et al. | |
| 2018/0305176 | A1* | 10/2018 | Miyajima | B66B 7/06 |
| 2020/0239274 | A1* | 7/2020 | Gurvich | B66B 1/28 |

FOREIGN PATENT DOCUMENTS

| | | | | |
|---|---|---|---|---|
| EP | 3693315 | A1 * | 8/2020 | B66B 1/3407 |
| JP | 2004250217 | A | 9/2004 | |
| JP | 2008068943 | A | 3/2008 | |
| JP | 4208425 | B2 | 1/2009 | |
| JP | 2009196807 | A | 9/2009 | |
| JP | 2010058940 | A | 3/2010 | |
| JP | 2013147315 | A | 8/2013 | |
| KR | 20130064103 | A * | 6/2013 | B66B 7/06 |
| WO | 2009/116985 | A1 | 9/2009 | |
| WO | WO-2009116985 | A1 * | 9/2009 | B66B 7/06 |
| WO | WO-2009116986 | A1 * | 9/2009 | B66B 1/2416 |
| WO | WO-2012015429 | A1 * | 2/2012 | B66B 7/06 |
| WO | WO-2012117479 | A1 * | 9/2012 | B66B 5/0031 |

OTHER PUBLICATIONS

Extended European Search Report for Application No. EP 19 21 5664 dated Jul. 24, 2020.

* cited by examiner

ELEVATOR SYSTEM CONTROL BASED ON BUILDING AND ROPE SWAY

BACKGROUND

Elevator systems are in widespread use for carrying passengers between various levels in buildings. Various factors affect elevator system operation at different times. For example, building sway conditions may introduce lateral movement of the roping of a traction-based elevator system. A variety of proposals have been made to control an elevator system in a way that should address such sway conditions.

One drawback associated with previous approaches is that the sensor devices that detect sway conditions tend to be expensive and provide limited information. Another issue associated with previous approaches is that they are not well-suited to address the more significant and potentially variable sway conditions that may be present in high rise and ultra-high rise buildings due to excessive building sway as an additional complication factor.

SUMMARY

An illustrative example elevator control system includes a plurality of sway sensors are situated within a hoistway of the building. The sway sensors respectively include a contact surface situated to be contacted by a vertically extending elongated member of an elevator when the elongated member moves laterally in the hoistway. The sway sensors respectively provide an indication of contact between the contact surface and the elongated member. A controller receives an indication of building movement and the indications from the sway sensors. The controller determines whether at least one condition exists in the hoistway based on the indications and implements an adjustment to elevator movement control when the at least one condition exists.

In an example embodiment having one or more features of the elevator control system of the previous paragraph, the condition in the hoistway comprises an undesirable amount or pattern of sway of the elongated member.

In an example embodiment having one or more features of the elevator control system of either of the previous paragraphs, the sway sensors are at respective, preselected vertical locations along the hoistway; and the controller uses information regarding the vertical location of any of the sway sensors that provides an indication of contact with the elongated member for determining whether the at least one condition exists.

In an example embodiment having one or more features of the elevator control system of any of the previous paragraphs, the contact surfaces of the sway sensors are moveable relative to a wall of the hoistway and the indication from each sway sensor includes an indication of movement of the contact surface in response to contact with the elongated member.

In an example embodiment having one or more features of the elevator control system of any of the previous paragraphs, the indication from each sway sensor includes an indication of at least one of a direction of movement of the contact surface, an amount of movement of the contact surface, a speed of movement of the contact surface, an acceleration of the contact surface, and a force incident on the contact surface associated with the movement of the contact surface.

In an example embodiment having one or more features of the elevator control system of any of the previous paragraphs, the controller determines a severity of a load transfer from the elongated member to the respective sway sensors.

In an example embodiment having one or more features of the elevator control system of any of the previous paragraphs, the sway sensors are at respective, preselected vertical locations along the hoistway; the controller determines the severity of the load transfer at each of the vertical location; and the controller determines whether the at least one condition exists based on the locations and severity of the load transfer.

In an example embodiment having one or more features of the elevator control system of any of the previous paragraphs, the sway sensors each comprise a roller, the contact surface of each sway sensor is a surface on the roller, the rollers each have an axis oriented at a selected angle relative to an adjacent hoistway wall, and the rollers are respectively supported to be moveable toward the adjacent hoistway wall in response to contact with the elongated member.

In an example embodiment having one or more features of the elevator control system of any of the previous paragraphs, the hoistway includes a plurality of walls and at least one of the rollers is aligned with each of the plurality of walls.

In an example embodiment having one or more features of the elevator control system of any of the previous paragraphs, the controller determines an amount or pattern of building sway from the indication of building movement, the controller determines an amount or pattern of elongated member sway from the sway sensors, and the controller determines whether the at least one condition exists based on the building sway and the elongated member sway.

In an example embodiment having one or more features of the elevator control system of any of the previous paragraphs, the at least one condition is one of a plurality of predetermined conditions, a first one of the predetermined conditions is different than a second one of the predetermined conditions, the controller implements a first adjustment when the first one of the predetermined conditions exists, and the controller implements a second adjustment that is different than the first adjustment when the second one of the predetermined conditions exists.

An example embodiment of an elevator system includes the elevator control system of any of the previous paragraphs and an elevator car. The elongated member comprises at least one of a traction rope suspending the elevator car, a traction belt suspending the elevator car, a compensation rope associated with the elevator car, and a travelling cable associated with the elevator car.

An illustrative example method of elevator control includes detecting lateral movement of a vertically extending elongated member of the elevator using a plurality of sway sensors situated within a hoistway of the building, determining whether at least one condition exists in the hoistway based on an indication of building movement and the detected lateral movement of the elongated member, and implementing an adjustment to elevator movement control when the at least one condition exists.

In an example embodiment having one or more features of the method of the previous paragraph, the condition in the hoistway comprises an undesirable amount or pattern of sway of the elongated member.

An example embodiment having one or more features of the method of any of the previous paragraphs includes determining vertical locations along the hoistway where the detected lateral movement occurs and determining whether the at least one condition exists based on the vertical locations.

In an example embodiment having one or more features of the method of any of the previous paragraphs, the respective sway sensors provide an indication of a reaction of the sway sensor to contact with the elongated member. The indication includes an indication of least one of a direction of movement of the sway sensor, an amount of movement of the sway sensor, a speed of movement of the sway sensor, an acceleration of the sway sensor, and a force incident on the sway sensor. The method also includes determining a severity of a load transfer from the elongated member to the respective sway sensors.

An example embodiment having one or more features of the method of any of the previous paragraphs includes determining the severity of the load transfer at each of a plurality of vertical locations along the hoistway and determining whether the at least one condition exists based on the locations and severity of the load transfer.

An example embodiment having one or more features of the method of any of the previous paragraphs includes determining an amount or pattern of building sway from the indication of building movement, determining an amount or pattern of elongated member sway from the sway sensors, and determining whether the at least one condition exists based on the building sway and the elongated member sway.

In an example embodiment having one or more features of the method of any of the previous paragraphs, the at least one condition is one of a plurality of predetermined conditions and a first one of the predetermined conditions is different than a second one of the predetermined conditions. The method also includes implementing a first adjustment when the first one of the predetermined conditions exists, and implementing a second adjustment that is different than the first adjustment when the second one of the predetermined conditions exists.

An example embodiment of an elevator system includes a controller configured to implement the method of any of the previous paragraphs and an elevator car. The elongated member comprises at least one of a traction rope suspending the elevator car, a traction belt suspending the elevator car, a compensation rope associated with the elevator car, and a travelling cable associated with the elevator car.

The various features and advantages of an example embodiment will become apparent to those skilled in the art from the following detailed description. The drawings that accompany the detailed description can be briefly described as follows.

DETAILED DESCRIPTION

Figure 1:
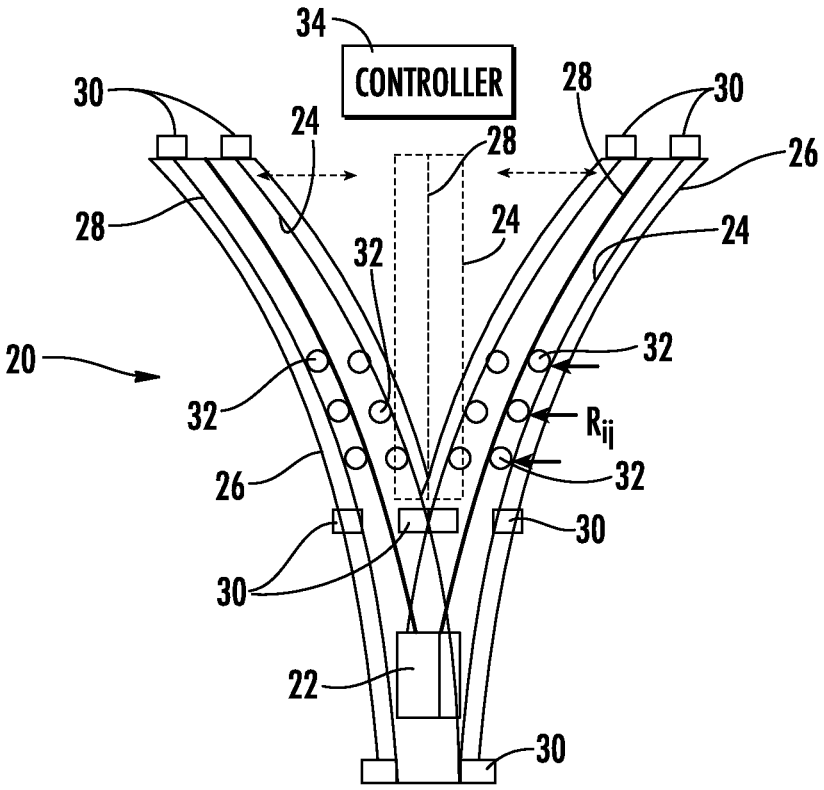
FIG. 1 schematically illustrates selected portions of an elevator system and building sway.

Selected portions of an elevator system 20 are schematically illustrated in FIG. 1. The elevator system 20 includes an elevator car 22 situated within a hoistway 24 of a building 26. The hoistway 24 may be situated in a variety of locations within the building 26, depending on the building configuration.

The example elevator system 20 is a traction-based system in which the elevator car 22 is suspended by a traction roping assembly 28, which may comprise round steel ropes or flat belts. Other aspects of the elevator system, which are known to those skilled in the art, are not illustrated such as a counterweight, compensation roping and a traveling cable. The individual ropes or belts of the traction roping assembly 28 are example types of vertically extending elongated members of the elevator system 20. The compensation roping and traveling cable (not illustrated) are other examples of elongated members. For discussion purposes, the elongated members of the traction roping assembly 28 are discussed below and, as those skilled in the art will appreciate, the issues pertaining to those elongated members may apply equally to other elongated members in the elevator system 20.

As schematically shown in FIG. 1, the building 26 moves in response to environmental conditions such as wind or an earthquake or non-uniform temperature distribution in the building. When the building 26 is a high rise or ultra-high rise building such movement will likely occur as a result of less stimulus and typically will include a larger extent or amount of movement. The illustrated example system includes building sensors 30 that detect movement of the building 26 and provide an output including an indication of the movement. Building sensor outputs may include quantitative indications regarding an amount or extent of movement, qualitative indications, (i.e., an indication of at least some movement or a measured reaction that is above or below a threshold), or a combination of quantitative and qualitative indications. The building sensors 30 in some embodiments comprise vibration sensors, accelerometers or strain gages. In other embodiments the building sensors 30 comprise gyroscopes, pendulums, video cameras or infrared imaging devices. Those skilled in the art who have the benefit of this description will be able to select appropriate building sensor devices for their particular situation.

In the situation represented in FIG. 1, the building 26 is swaying from side to side. When that occurs, the hoistway 24 also moves from side to side from a centered or rest position shown in broken lines in the middle of FIG. 1 to the positions or orientations shown on the right and left, respectively. When the hoistway 24 is in the centered or rest position, the elongated members of the traction roping assembly 28 are typically vertical and follow a path of movement that is unhindered. When the building 26 and the hoistway 24 move as illustrated, however, the elongated members of the traction roping assembly 28 move laterally away from a true vertical or design orientation. In some cases, the elongated members may move far enough laterally to contact the walls of the hoistway 24 or other elevator system components within the hoistway 24.

The illustrated example system 20 includes sway sensors 32 situated within the hoistway 24. The sway sensors 32 include a contact surface situated to be contacted by an elongated member of the traction roping assembly 28 if the elongated member moves sufficiently laterally to make such contact. The sway sensors 32 provide an output including an indication of such contact.

A controller 34 receives the indications from the building sensors 30 and the sway sensors 32. The communications between the sensors 30, 32 and the controller 34 may be wireless, line-based or part of a local or globally-integrated Internet of Things communication network. The controller 34 uses the indications from the sensors 30, 32 to determine whether a condition exists within the hoistway 24 that warrants adjusting control over movement of the elevator car. For example, the condition may include an amount or pattern or elongated member sway within the hoistway 24 that should be addressed by adjusting control of the elevator system movement. Another condition may include an amount or pattern of building sway. In the illustrated example, the controller 34 has access to information regarding a plurality of predetermined possible conditions and sensor indications corresponding to such conditions so that the controller 34 is capable of identifying when one or more of those conditions exist.

The controller 34 also has information or programming so that the controller 34 determines an appropriate adjustment to elevator car movement control to address the current condition or conditions. For example, some sway frequencies will correspond to a resonant frequency of the elongated members of the roping assembly 28 if the elevator car 22 is at certain locations along the hoistway 24. The controller 34 determines when such sway conditions exist and controls movement of the elevator car 22 to avoid being in those locations, which may be considered critical zones because it is desirable to avoid rope or belt sway at a resonant frequency.

Figure 2:
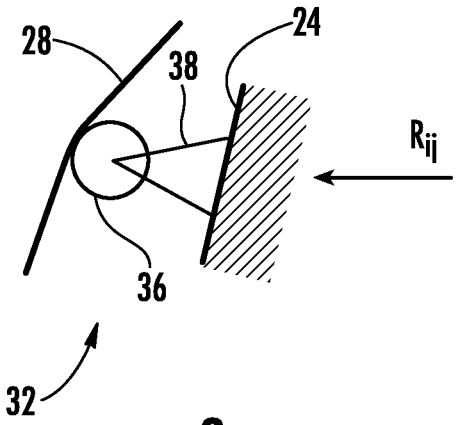
FIG. 2 schematically illustrates an example sway sensor.
Figure 3:
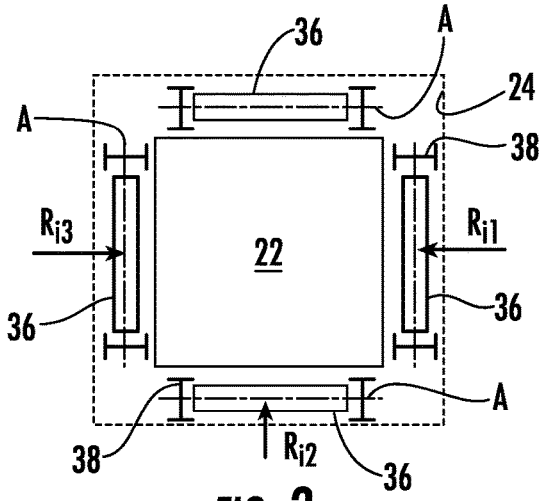
FIG. 3 is a schematic, cross-sectional horizontal view of an example arrangement of sway sensors within a hoistway.

FIGS. 2 and 3 schematically show features of example sway sensors 32. In this example, the sway sensors 32 include bumpers 36 that are situated near the walls of the hoistway 24. The bumpers 36 each include a contact surface facing toward the interior of the hoistway 24. The bumpers 36 provide some cushion or protection for the elongated member in the event of contact between them. The bumpers 36 also protect the elongated member from contacting the hoistway wall. The bumpers 36 may be designed as cylindrical or almost cylindrical rollers to minimize potential shear sliding between the elongated member and the contact surface of the bumpers. In some embodiments, the bumpers 36 comprise idler rollers that have effectively no resistance against rotation.

The example bumpers 36 comprise rollers that are situated so an axis of rotation A of each roller is parallel to an adjacent wall of the hoistway 24. A support structure 38 positions the bumper 36 away from the wall of the hoistway 24. In the illustrated example, the support structure 38 allows some movement of the bumper 36 toward the adjacent hoistway wall in response to contact with the elongated member. The sway sensors 32 provide an indication of such movement by indicating at least one of a direction of such movement, an amount of such movement, a speed of such movement, acceleration during such movement, and a force associated with such movement. In some embodiments the controller 34 determines one or more of such features of such movement.

In some embodiments the bumpers 36 do not move relative to the hoistway walls but do deflect or deform in response to contact with an elongated member. In those embodiments, the sway sensors 32 are configured to provide an indication of such contact based on the resulting deflection or deformation.

One aspect of the sway sensors 32 is that they are respectively situated at preselected and known vertical locations along the hoistway 24. The controller 34 determines a reaction $R_{ij}$ of each sway sensor 32 to contact with an elongated member and the location of that reaction. In this example, i corresponds to the vertical position or location in the building and j corresponds to the orientation of the reaction. The reaction is based on the indication of movement, deflection, load or a combination of them provided by the sway sensors 32. Based on those reactions and their respective locations, the controller 34 determines a severity of load transfer from the elongated member(s) to the sway sensors 32. That load transfer information is useful for the controller 34 to determine how to adjust control over the movement of the elevator car 22.

Figure 4:
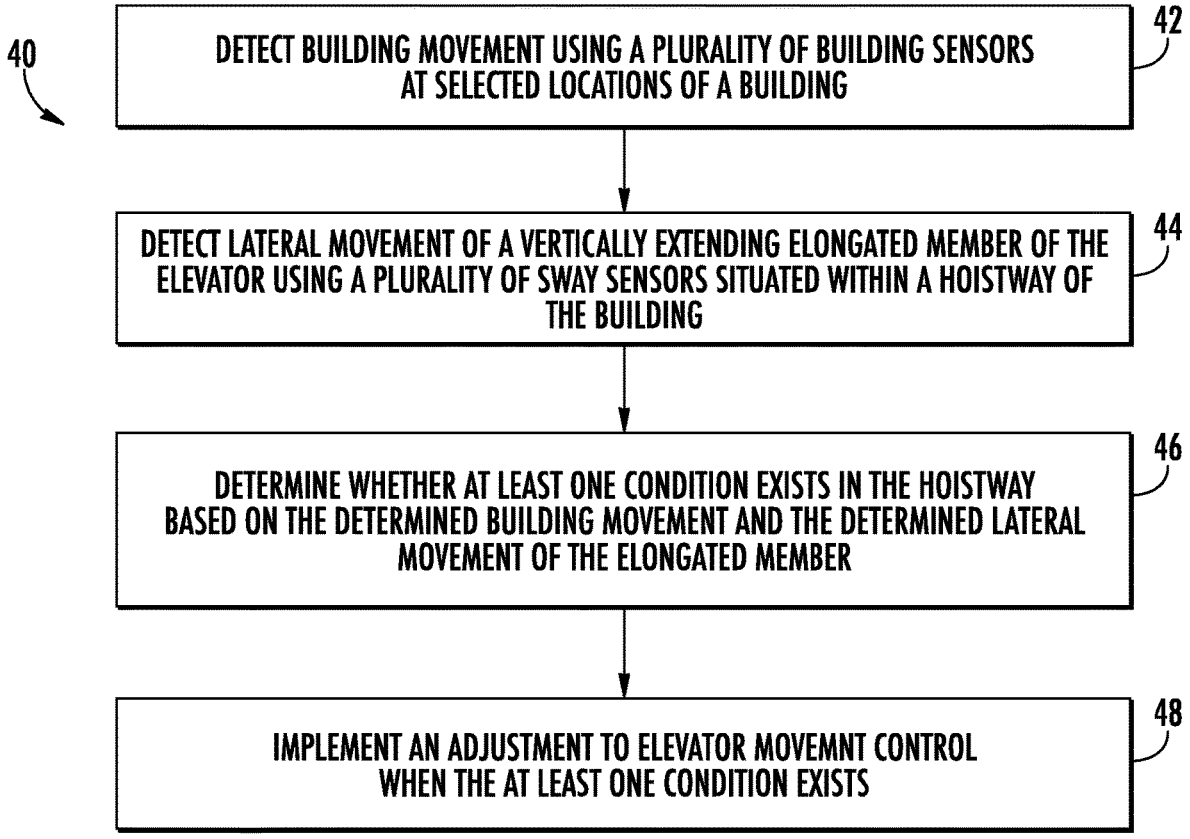
FIG. 4 is a flow chart diagram summarizing an example control technique based on a building sway condition.

An example control strategy implemented by the controller 34 is summarized in the flow chart diagram 40 of FIG. 4. At 42 the building sensors 30 detect movement of the building 26. The building sensors 30 respectively provide an indication of the movement of a portion of the building 26 that is situated in a location corresponding to the building sensor 30 location. At 44, the sway sensors 32 detect lateral movement of the elongated member(s). The controller 34 receives the indications from the building sensors 30 and the sway sensors 32 and determines, at 46, whether at least one condition exists in the hoistway 24 based on the detected building movement and the detected lateral movement of the elongated member.

Determining whether at least one condition exists at 46 in some embodiments is based on information available to the controller 34 regarding known or expected characteristics of building or elongated member movement corresponding to a set of sensor indications. For example, the controller 34 is programmed or otherwise configured to analyze quantifiable correlations between sensor indications and movement of the building 26 or elongated members of the elevator system 20.

Some example controller 34 embodiments utilize information regarding theoretical predictions developed according to established methods of structural analysis and known features or characteristics of the building 26 and the elevator system 20. Other embodiments include empirical predictions based on direct measurements from the sensors 30 and 32 and quantified correlations of such measurements and actual building or elongated member movement. Some embodiments include a machine learning approach for correlating measured or detected movement and resulting conditions within the hoistway 24. Some embodiments include combinations of any two or more of the above-noted analytical (e.g., based on predictive methods of structural analysis), empirical (e.g., based on direct measurements) and machine learning based approaches. Those skilled in the art who have the benefit of this description will be able to select an appropriate approach for their particular implementation.

One way in which the disclosed example embodiment improves on detecting sway conditions and controlling elevator system movement is that it combines information regarding building movement and elongated member movement for determining what conditions exist in the hoistway. Since building movement and elongated member movement can contribute to resulting conditions in the hoistway in different manners under different combinations of such movements, the illustrated system provides more versatility and accuracy over elevator movement control.

Another improvement over previous sway detection arrangements is based on the plurality of sway sensors 32 situated along the hoistway. The sway sensors 32 may be strategically placed where the most significant lateral movement of the elongated members is expected to protect the components of the elevator system while also providing indications of the most significant load transfer.

The illustrated embodiment also provides the ability to assess building integrity and any potential changes to the structural components of the elevator system.

Elevator system control consistent with the disclosed example embodiment provides more specific and effective control over the position, movement or both of the elevator based upon characteristics of a condition within the hoistway. Such response to particular characteristics of building movement and elongated member movement improves the ability to maintain a desired condition of elevator system components and achieve a desired elevator system performance.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator control system, comprising:

a plurality of sway sensors situated within a hoistway of a building, the sway sensors respectively including a contact surface situated to be contacted by a vertically extending elongated member of an elevator when the elongated member moves laterally in the hoistway, the sway sensors respectively providing an indication of contact between the contact surface and the elongated member;

at least one building sensor that detects movement of the building and provides indication of detected building movement; and a controller that receives the indication of building movement from the at least one building sensor and the indications from the sway sensors, wherein the controller determines whether at least one condition exists in the hoistway based on the indications, the controller determines an amount or pattern of building sway from the indication of building movement, the controller determines an amount or pattern of elongated member sway from the sway sensors, the controller determines whether the at least one condition exists based on the building sway and the elongated member sway, and the controller implements an adjustment to elevator movement control when the at least one condition exists.

2. The elevator control system of claim 1, wherein the condition in the hoistway comprises an undesirable amount or pattern of sway of the elongated member.

3. The elevator control system of claim 1, wherein the sway sensors are at respective, preselected vertical locations along the hoistway; and the controller uses information regarding the vertical location of any of the sway sensors that provides an indication of contact with the elongated member for determining whether the at least one condition exists.

4. The elevator control system of claim 1, wherein the contact surfaces of the sway sensors are moveable relative to a wall of the hoistway; and the indication from each sway sensor includes an indication of movement of the contact surface in response to contact with the elongated member.

5. The elevator control system of claim 4, wherein the indication from each sway sensor includes an indication of at least one of a direction of movement of the contact surface, an amount of movement of the contact surface, a speed of movement of the contact surface, an acceleration of the contact surface, and a force incident on the contact surface associated with the movement of the contact surface.

6. The elevator control system of claim 5, wherein the controller determines a severity of a load transfer from the elongated member to the respective sway sensors.

7. The elevator control system of claim 6, wherein the sway sensors are at respective, preselected vertical locations along the hoistway;

the controller determines the severity of the load transfer at each of the vertical location; and the controller determines whether the at least one condition exists based on the locations and severity of the load transfer.

8. The elevator control system of claim 1, wherein the sway sensors each comprise a roller;

the contact surface of each sway sensor is a surface on the roller;

the rollers each have an axis oriented at a selected angle relative to an adjacent hoistway wall; and the rollers are respectively supported to be moveable toward the adjacent hoistway wall in response to contact with the elongated member.

9. The elevator control system of claim 8, wherein the hoistway includes a plurality of walls; and at least one of the rollers is aligned with each of the plurality of walls.

10. The elevator control system of claim 1, wherein the at least one condition is one of a plurality of predetermined conditions;

a first one of the predetermined conditions is different than a second one of the predetermined conditions;

the controller implements a first adjustment when the first one of the predetermined conditions exists; and the controller implements a second adjustment that is different than the first adjustment when the second one of the predetermined conditions exists.

11. An elevator system, comprising the elevator control system of claim 1 and an elevator car, and wherein the elongated member comprises at least one of a traction rope suspending the elevator car, a traction belt suspending the elevator car, a compensation rope associated with the elevator car, and a travelling cable associated with the elevator car.

12. A method of elevator control, the method comprising:

detecting lateral movement of a vertically extending elongated member of the elevator using a plurality of sway sensors situated within a hoistway of a building;

detecting movement of the building using at least one building sensor;

determining an amount or pattern of building sway based on an indication of building movement from the building sensor;

determining an amount or pattern of elongated member sway based on indications from the sway sensors;

determining whether at least one condition exists in the hoistway based on the building sway and the elongated member sway; and implementing an adjustment to elevator movement control when the at least one condition exists.

13. The method of claim 12, wherein the condition in the hoistway comprises an undesirable amount or pattern of sway of the elongated member.

14. The method of claim 12, comprising determining vertical locations along the hoistway where the detected lateral movement occurs; and determining whether the at least one condition exists based on the vertical locations.

15. The method of claim 12, wherein the respective sway sensors provide an indication of a reaction of the sway sensor to contact with the elongated member, the indication including an indication of least one of a direction of movement of the sway sensor, an amount of movement of the sway sensor, a speed of movement of the sway sensor, an acceleration of the sway sensor, and a force incident on the sway sensor; and the method comprises determining a severity of a load transfer from the elongated member to the respective sway sensors.

16. The method of claim 15, comprising determining the severity of the load transfer at each of a plurality of vertical locations along the hoistway; and determining whether the at least one condition exists based on the locations and severity of the load transfer.

17. The method of claim 12, wherein the at least one condition is one of a plurality of predetermined conditions;

a first one of the predetermined conditions is different than a second one of the predetermined conditions; and the method comprises implementing a first adjustment when the first one of the predetermined conditions exists; and implementing a second adjustment that is different than the first adjustment when the second one of the predetermined conditions exists.

18. An elevator system, comprising a controller configured to implement the method of claim 12 and an elevator car, and wherein the elongated member comprises at least one of a traction rope suspending the elevator car, a traction belt suspending the elevator car, a compensation rope associated with the elevator car, and a travelling cable associated with the elevator car.

* * * * *